US006019124A

United States Patent [19]

Sebion et al.

[11] Patent Number: 6,019,124

[45] Date of Patent: Feb. 1, 2000

[54] VALVE ASSEMBLY FOR USE WITH HIGH PRESSURE PUMPS

[75] Inventors: Timothy L. Sebion, Lakeville; Frederick Allan Powers, Mape Grove, both of Minn.

[73] Assignee: Wanner Engineering, Inc., Minneapolis, Minn.

[21] Appl. No.: 09/004,901

[22] Filed: Jan. 9, 1998

[51] Int. Cl.[7] ..... F16K 15/02

[52] U.S. Cl. ..... 137/454.4; 137/543.19; 251/362; 417/571

[58] Field of Search ..... 137/454.4, 454.6, 137/543.19; 251/361, 362; 417/571

[56] References Cited

U.S. PATENT DOCUMENTS 2,673,062 3/1954 Cornelius ..... 251/361 X
3,471,123 10/1969 Carlson et al. ..... 251/362
4,140,442 2/1979 Mulvey ..... 137/454.4 X
4,926,895 5/1990 Gailey ..... 251/361 X

*Primary Examiner*—Stephen M. Hepperle
*Attorney, Agent, or Firm*—Merchant & Gould P.C.

[57] ABSTRACT

The present disclosure relates generally to a valve assembly including a valve body and a poppet member for controlling flow through the valve body. The valve assembly also includes a valve seat adapted to interface with the poppet member to provide a fluid seal, and seat retaining member adapted to be compressed against the valve seat. Additionally, the valve assembly includes a deformable elastic spacer arranged and configured to axially compress the valve body and the seat retaining member together such that relative movement between such components is inhibited.

19 Claims, 5 Drawing Sheets

VALVE ASSEMBLY FOR USE WITH HIGH PRESSURE PUMPS

FIELD OF THE INVENTION

The present invention relates generally to valve assemblies. More particularly, the present invention relates to valve assemblies for incorporation within high-pressure pumps such as high-pressure diaphragm pumps.

BACKGROUND OF THE INVENTION

High-pressure pumps are commonly used to pump abrasive slurries such as tile-glazing clays, flue gas desulferization, and coating slurries for investment castings. Pump life is a significant factor that must be considered when designing pumps suitable for pumping abrasive slurries. Rotary operated oil backed diaphragm pumps, such as those described in U.S. Pat. Nos. 3,775,030 and 3,884,598, are inherently suited for use as high-pressure pumps capable of pumping abrasive slurries because they require no sliding pistons or rubber seals that are likely to abrade. The durability limitation of such pumps is generally controlled by the inlet and outlet plate and/or ball valves used. Typically, such inlet and outlet plates and/or ball valves fail magnitudes of time sooner than the other pump elements. What is needed is a pump valving assembly having improved abrasion resistance characteristics.

SUMMARY OF THE INVENTION

The present invention relates generally to a valve assembly having various features and/or aspects for improving abrasion resistance so as to improve pump life. More specifically, it has been determined by the inventors that relative movement between valve components is a significant factor in causing premature valve failure. This is especially true with respect to pumps designed to handle abrasive material such as abrasive slurries. Consequently, certain aspects of the present invention relate to valve configurations and/or designs adapted for inhibiting relative movement between the various components of a particular valve.

One aspect of the present invention relates to a valve assembly positionable between two compression plates of a pump. The valve assembly includes a valve body having first and second oppositely disposed ends. A spring-retaining structure is disposed within the valve body, and a retaining washer is positioned at the first end of the valve body to secure the spring-retaining structure within the valve body. The valve assembly also includes a poppet member for controlling flow through the valve body. The poppet member is moveable between open and closed positions. A poppet spring mounted on the spring-retaining structure biases the poppet member toward the closed position. The valve assembly additionally includes a valve seat configured for providing a seal with the poppet member when the poppet member is in the closed position. The valve seat is captured between the retaining washer and a first end piece. The valve assembly further includes an annular spacer positioned adjacent the second end of the valve body and mounted in a spacer groove formed between the valve body and a second end piece. The spacer is arranged and configured to be compressed and elastically deformed within the spacer groove when the valve assembly is pressed between the compression plates. In this manner, the spacer functions to maintain compression between the various components of the valve assembly so as to inhibit relative movement between the valve components.

Another aspect of the present invention relates to a valve assembly including a relatively hard poppet member that interfaces with a relatively soft elastic or elastomeric valve seat. For example, the poppet member can be made of a material such as ceramic while the valve seat can be made of a material such as urethane or polyester. By using an elastomeric valve seat, abrasion of both the poppet member and the valve seat is resisted because the valve seat preferably has enough "give" to not force abrasive particles into the poppet member. Additionally, the valve seat preferably has a sealing surface that is large enough to minimize localized stresses on the elastomeric valve seat.

Another aspect of the present invention relates to a valve assembly including a valve body, a poppet member for controlling flow through the valve body, a valve seat for receiving the poppet member to provide a seal, and a seat retaining member adapted to secure the valve seat adjacent to the valve body. The seat-retaining member and the valve seat interface with one another such that when the valve assembly is compressed, such as between compression plates of a pump, the first region is required to be compressed before the second region can be compressed. By precompressing certain regions of the valve seat, movement of the valve seat relative to the other components of the valve can be controlled and inhibited.

An additional aspect of the present invention relates to a valve assembly including an outer seal member mounted within an outer annular groove defined by a component of the valve assembly. The sealing member and the outer annular groove are relatively sized and shaped such that when the valve assembly is mounted within a structure, such as an inlet or outlet port, the sealing member is compressed so as to substantially completely fill the volume defined by the outer annular groove. In this manner, because the groove is substantially 100% filled, the sealing member is not free to slide back and forth within the groove in response to suction and pressure cycles.

A further aspect of the present invention relates to a valve assembly having a poppet member biased towards a closed position by a coil spring. The coil spring has end portions that are preferably ground flat. To reduce wear of the flattened end portions, the spring is compressed within the valve such that the flattened end portions engage subsequent coils of the spring. Consequently, when the poppet member moves between open and closed positions, substantially no relative movement is generated between the flattened end portions and the subsequent coils. As a result, interior abrasive wear of the flattened end portions is inhibited. Furthermore, exterior wear of the flattened end portions can also be inhibited by using elastomeric coatings, members, disks, layers or washers.

One additional aspect of the present invention relates to a valve assembly including a valve body, a poppet member for controlling flow through the valve body, a valve seat adapted to interface with the poppet member to provide a fluid seal, and a seat-retaining member for securing the valve seat adjacent to the valve body. The valve assembly also includes a deformable elastic spacer arranged and configured to axially compress the valve body and the seat-retaining member together such that relative movement between such components is inhibited.

The above summary and the following detailed description recite numerous aspects of the present invention. It will be appreciated that each of the aspects can be used alone or in combination to provide a valve assembly constructed in accordance with the principles of the present invention. It will also be appreciated that valve assemblies in accordance with the principles of the present invention can be incorporated within various types of fluid-conveying apparatuses such as pumps or any other type of apparatus requiring durable valving.

A variety of additional advantages of the invention will be set forth in part in the description which follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompany drawings, which are incorporated in and constitute a part of this specification, illustrate several aspects of the invention and together with the description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 1:
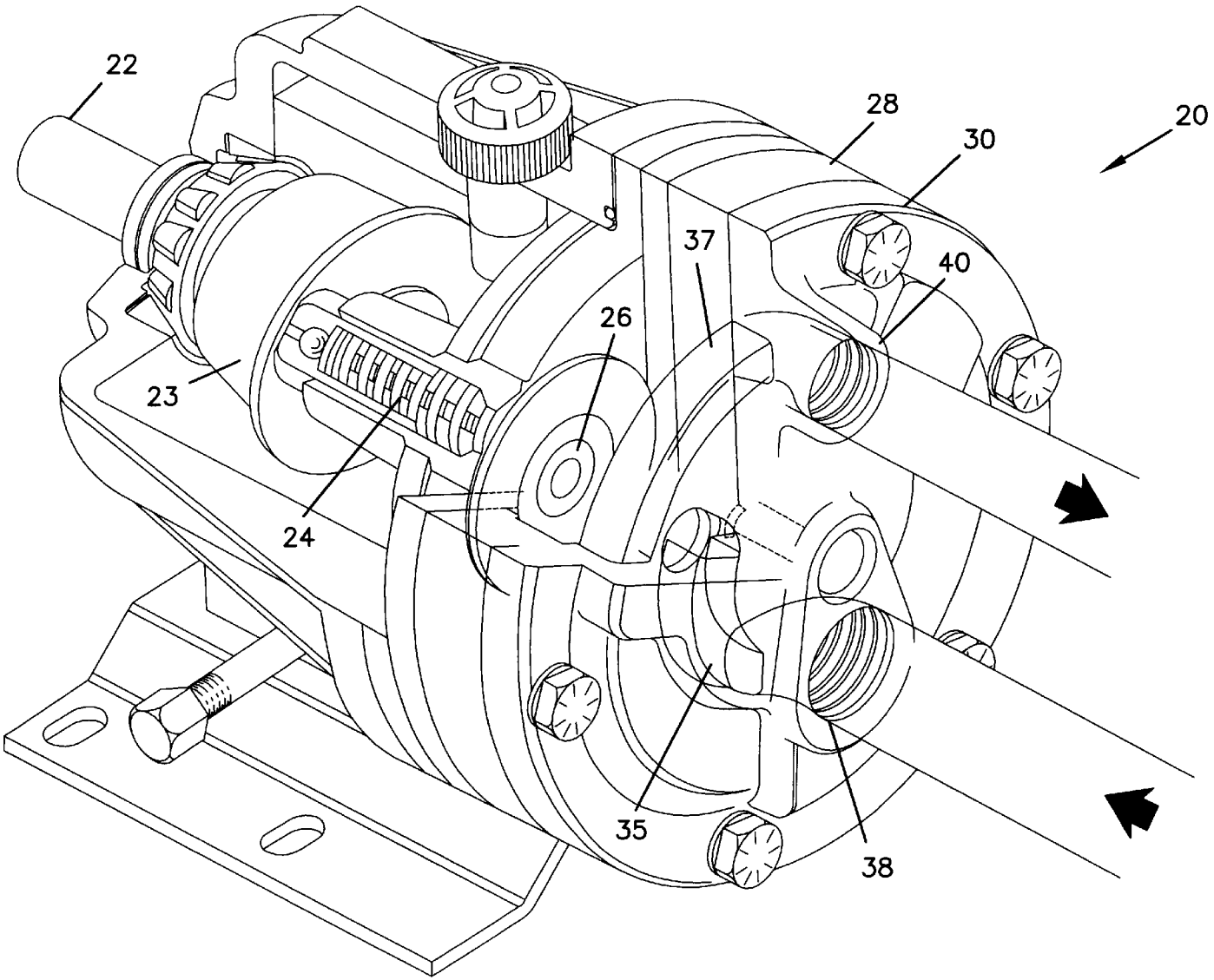
FIG. 1 illustrates an exemplary pump in which a valve assembly in accordance with the principles of the present invention can be used.

FIG. 1 illustrates a pump 20 in which a valve assembly in accordance with the principles of the present invention can be incorporated. It will be appreciated that the pump 20 is just one example of many different types of pumps or other type of fluid conveying devices in which valves in accordance with the principles of the present invention can be incorporated. Consequently, the pump 20 is intended to provide an example of the type of environment in which the present invention may be utilized, and should not be construed as a limitation upon the scope of the present invention.

The pump 20 is a positive displacement pump having a drive shaft 22 mounted within the pump via roller bearings. The drive shaft 22 powers a fixed angle cam or wobble plate 23 adapted for converting rotational motion into linear or axial motion. The pump 20 further includes three or more pistons 24 that are serially displaced by the wobble plate. Oil held in the piston cells alternately pressurizes and de-pressurizes the backside of diaphragms 26 causing the diaphragms 26 to flex back and forth as the pistons reciprocate, thus providing a pumping action.

The pump 20 also includes a valve plate 28 secured to a manifold plate 30. The valve plate 28 defines pumping chambers 32 (shown in FIG. 2) that correspond to each diaphragm 26. Each of the chambers 32 is in fluid communication with a chamber inlet 34 and a chamber outlet 36. As the diaphragms 26 retract, fluid enters the chambers 32 through the chamber inlets 34. By contrast, as the diaphragms expand, fluid is pushed from the chambers 32 through the chamber outlets 36. Fluid communication between the chamber inlets 34 is provided by a radially inner annular channel formed in the manifold plate 30, while fluid communication between the chamber outlets 36 is provided by a radially outer annular channel 37 formed in the manifold plate 30.

In operation, as the diaphragms retract, fluid enters the pump 20 through an inlet manifold port 38 formed by the manifold plate 30. The fluid entering the inlet manifold port 38 flows through the chamber inlets 34 as the diaphragms 26 retract. On the forward stroke of the diaphragms 26, the fluid is forced from the chambers 32 out the chamber outlets 36 and exits the pump through an outlet manifold port 40 formed by the manifold plate 30. The diaphragms 26, which in the embodiment shown in FIG. 1 are equally spaced about 120° from one another, operate sequentially to provide constant, virtually pulse-free flow of fluid.

Figure 2:
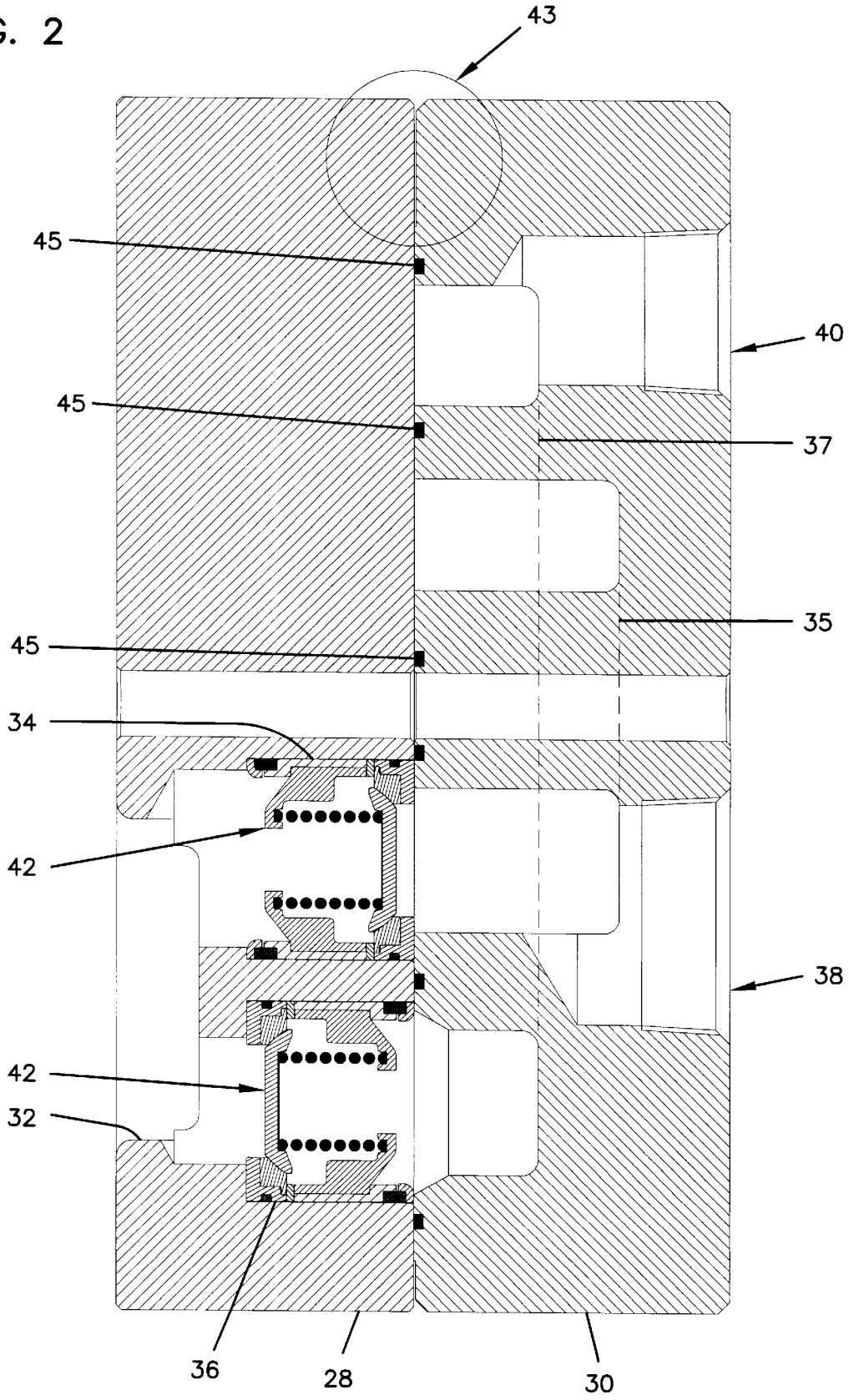
FIG. 2 is a cross-sectional view taken through the valve and manifold plates of the pump of FIG. 1, a valve assembly in accordance with the principles of the present invention is shown positioned within the valve plate.

FIG. 2 is a cross-sectional view through the valve and manifold plates 28 and 30 of the pump 20. As shown in FIG. 2, valve assemblies 42 in accordance with the principles of the present invention (for clarity the valve assemblies are not shown in FIG. 1) are mounted within the chamber inlets and outlets 34 and 36 of the pump 20. As mounted within the pump 20, the valve assemblies 42 function as check valves for controlling fluid flow through the chambers 32. Specifically, when the diaphragms 26 retract, the valve assemblies 42 allow fluid to flow into the chambers 32 through the inlets 34, and prevent fluid from entering the chambers 32 through the outlets 36. By contrast, when the diaphragms 26 make a forward stroke, the valve assemblies 42 allow fluid to exit the chambers 32 through the outlets 36, but prevent fluid from exiting the chambers through the inlet 34.

Figure 3A:
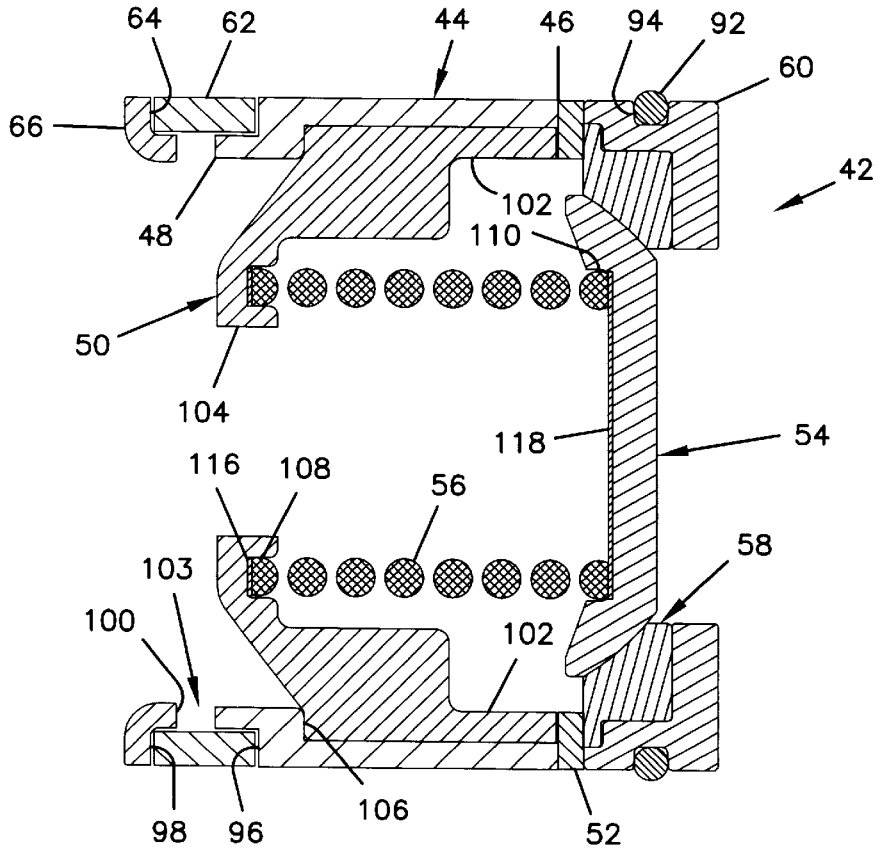
FIG. 3A is a cross-sectional view of the valve assembly of FIG. 2, the valve assembly is shown in a closed position.
Figure 3B:
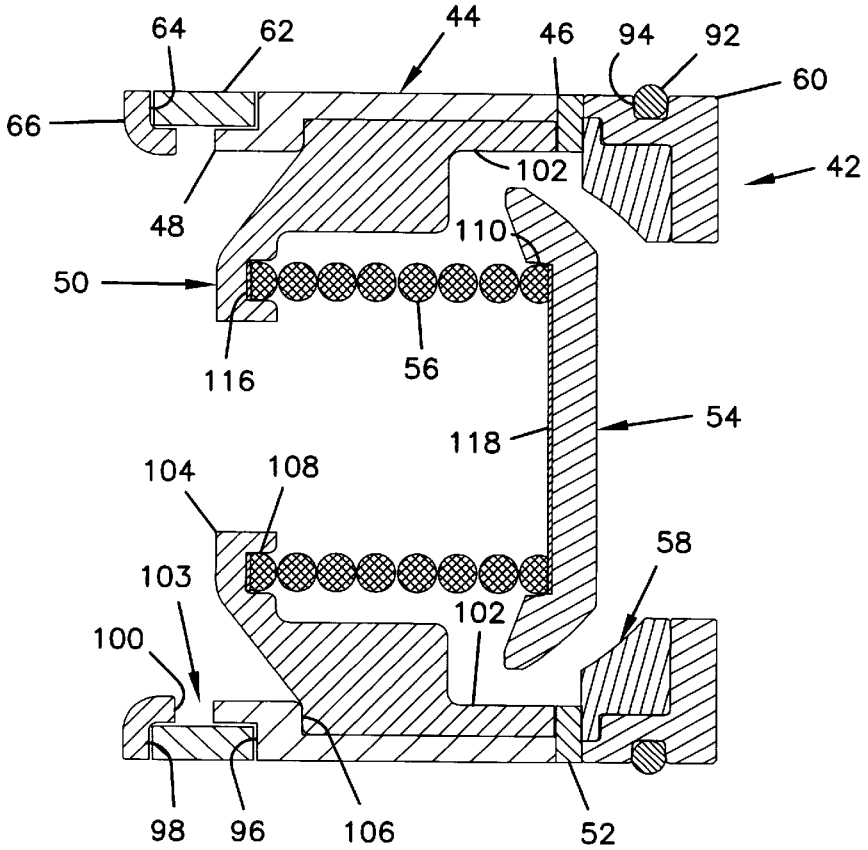
FIG. 3B is a cross-sectional view of the valve assembly of FIG. 2, the valve assembly is shown in an open position.

Referring now to FIGS. 3A and 3B, the valve assembly 42 generally includes a hollow valve body 44 having first and second oppositely disposed ends 46 and 48. A spring-retaining structure or cage 50 is disposed within the valve body 44, and is held within the valve body 44 by a retaining washer 52 located at the first end 46 of the valve body 44. The valve assembly 42 also includes a poppet member 54 for controlling flow through the valve body 44. The poppet member 54 is moveable between a closed position (shown in FIG. 3A) and an open position (shown in FIG. 3B). A poppet spring 56, adapted for biasing the poppet member 54 toward the closed position, is mounted on the spring-retaining structure 50. The valve assembly 42 additionally includes a valve seat 58 adapted to interface with the poppet member 54 to provide a fluid seal when the poppet member 54 is in the closed position. The valve seat 58 is captured between the retaining washer 52 and a seat-retaining member such as an annular first end piece 60. The valve assembly 42 further includes an annular spacer 62 mounted in a spacer groove 64 defined between the second end 48 of the valve body 44 and a second end piece 66 such as an annular clamp bracket. The spacer 62 is arranged and configured to be compressed and elastically deformed within the spacer groove 64 when the valve assembly 42 is pressed between the valve and manifold plates 28 and 30.

When the valve assemblies 42 are placed within the pump 20, the valve assemblies 42 are held in place by sandwiching the assemblies 42 between the valve and manifold plates 28 and 30. In certain embodiments, the valve and manifold plates 28 and 30 are bolted together and are arranged and configured to evenly compress the valve assemblies 42 to prevent movement and resulting abrasion of the valve assemblies 42 and the plates 28 and 30. To assist in maintaining even compression on the valve assemblies 42, certain embodiments of the present invention can have manifold plates 30 that are undercut at certain areas such that compression forces are focused directly on the end pieces 60 and 66 of the valve assemblies 42. For example, a radially outer annular recessed region 43 is defined by the manifold plate 30 to ensure that the valve assemblies 42, as well as annular passage seals 45, are subjected to adequate compression. Although the invention is not so limited, certain embodiments of the present invention can utilize valve and manifold plates 28 and 30 made of high-strength and high-stiffness abrasion-resistant plastic.

The valve seat 58 is generally annular and in certain embodiments is made of a relatively soft, flexible, elastomeric and abrasion-resistant material such as urethane, polyurethane or polyester. By contrast, the poppet member 54 is generally disk-shaped and is preferably made of a relatively hard material such as ceramic. By using a relatively hard poppet in combination with a relatively soft valve seat, abrasion of both valve components is inhibited. Specifically, although materials such as ceramic are hard, certain particles found in abrasive slurry can be harder. Consequently, a ceramic seat with a ceramic poppet would drive abrasive particles into the ceramic pieces starting craters and resulting in the premature abrasion of such pieces. In contrast, by using a relatively soft and elastic valve seat in combination with a relatively hard poppet, abrasive particles are not typically driven into the poppet. Instead, when the poppet is closed, abrasive particles captured or compressed between the poppet and the valve seat are temporarily embedded or pressed within the valve seat. The valve seat is preferably manufactured of an elastic material having a sufficient balance of elasticity and strength to not force such trapped abrasive particles at high stresses into the poppet, while not breaking into the elastic material surface.

Figure 5:
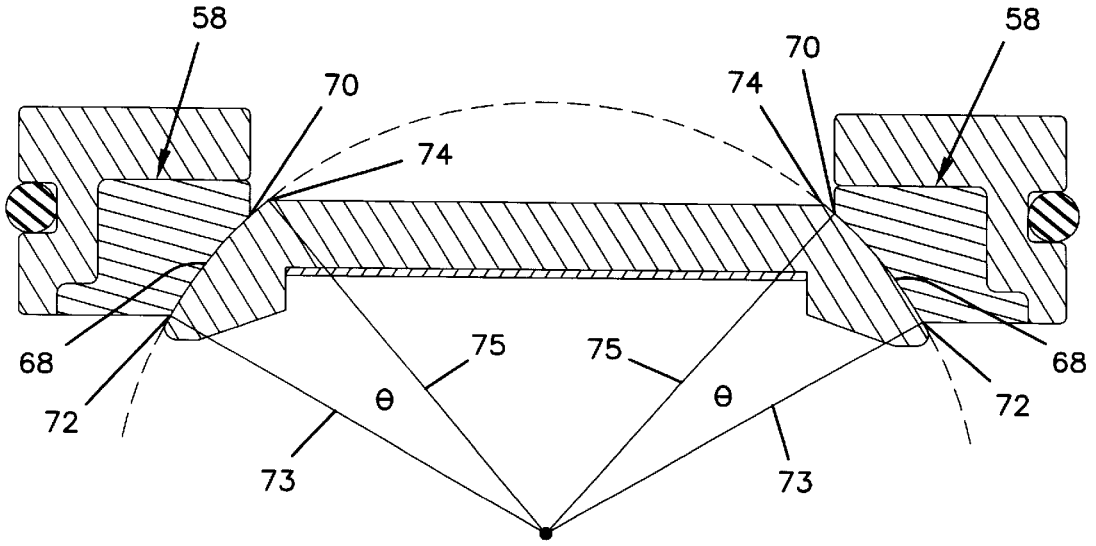
FIG. 5 is an enlarged view of the valve seat and poppet head of the valve assembly of FIGS. 3A and 3B.

Referring now to FIG. 5, the valve seat 58 includes an inner sealing surface 68 adapted to engage a corresponding outer sealing surface 70 formed about an outer side or face of the poppet member 54 to provide a fluid, tight seal. The inner and outer sealing surfaces 68 and 70 are generally annular and preferably have an area that is sufficiently large to minimize localized stresses on the valve seat 58. In selecting the size and configuration of the sealing surfaces 68 and 70, it is desirable to keep stresses low on the valve seat 58 in order to inhibit extrusion of the valve seat 58. In one particular embodiment of the present invention, the valve seat 58 is made from a material having a 75–85 Durometer Shore A hardness at up to 400 psig. With a valve seat having such a hardness, a preferred configuration of the sealing surfaces 68 and 70 includes an outer boundary 72 defined by a first radius 73 of a sphere, and an inner boundary 74 defined by a second radius 75 of the sphere. The first and second radiuses 73 and 75 are preferably arranged as to form an angle θ in the range of 17–27°.

As shown in FIG. 5, the sealing surfaces 68 and 70 have curvatures which match the curvature of the sphere. Consequently, the poppet member 54 has a truncated spherical shape while the valve seat 58 defines a truncated spherical opening. While the sealing surfaces 68 and 70 are illustrating as having truncated spherical shapes, it would be appreciated that such surfaces could also have truncated conical shapes or any other suitable shape for providing a seal. It will also be appreciated that the above-described and depicted and sealing configuration is representative of but one embodiment of the present invention and is not intended to be construed as a limitation on the scope of the present invention.

Figure 4:
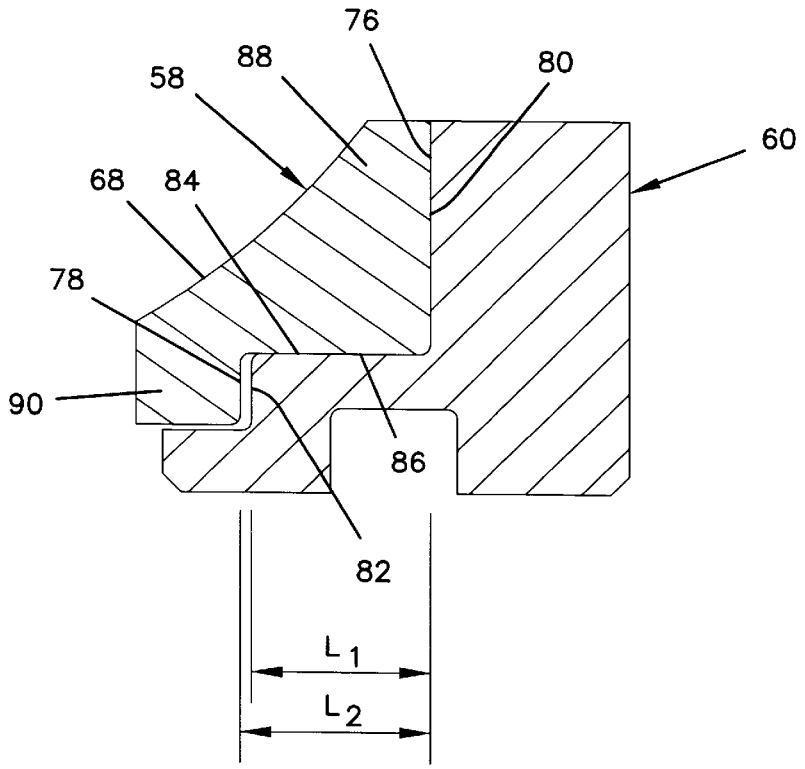
FIG. 4 is an enlarged view showing the valve seat and valve retaining member of the valve assembly of FIGS. 3A and 3B.

Referring now to FIG. 4, the valve seat 58 also includes an outer side that interfaces with an inner side of the first end piece 60. The outer side of the valve seat 58 includes first and second transverse seat surfaces 76 and 78 that face corresponding first and second transverse seat retaining surfaces 80 and 82 formed on the first end piece 60. The first and second transverse seat surfaces 76 and 78 are interconnected by an axial seat surface 84. Similarly, the first and second transverse seat retaining surfaces 80 and 82 are interconnected by an axial seat retaining surface 86 that faces the axial seat surface 84. The axial seat retaining surface 86 has an axial length $L_1$ that is shorter than the non-compressed axial length $L_2$ of the axial seat surface 84. Consequently, when the valve assembly 42 is assembled and compressed between the valve and manifold plates 28 and 30, the first transverse seat surface 76 is required to be compressed by the first transverse seat retaining surface 80 before the second transverse seat surface 78 can be compressed by the second transverse seat retaining surface 82. As a result, the radially innermost portion or region of the valve seat 58 is compressed more than the radially outermost portion of the valve seat 58. In one exemplary embodiment of the present invention, the radially innermost region has a nominal compression of 0.015" while the radially outermost region has a nominal compression of 0.008".

The valve seat 58 can also be described as having a radially inner primary region 88 and a secondary region 90 projecting radially outward from the primary region 88. The primary region 88 is subjected to a higher compression than the secondary region 90. This ensures that both required compression points will always be in compression regardless of required manufacturing tolerances. Keeping all elements in compression inhibits relative movement and resultant abrasion of any or all of the valve components.

Referring back to FIGS. 3A and 3B, the valve assembly 42 also includes an exterior sealing member 92 for providing a seal between the valve assembly 42 and the valve plate 28. In one particular embodiment, the exterior sealing member 92 is an O-ring mounted within an outer annular groove 94 defined by the first end piece 60. The exterior sealing member 92 and the outer annular groove 94 are preferably relatively shaped and sized such that when the valve assembly 42 is compressed within either the inlet or outlet port 34 or 36 of the valve plate 28, the sealing member 92 substantially completely fills the entire volume of the outer annular groove 94 (as shown in FIG. 2). In other words, the exterior sealing member 92 is preferably designed to substantially 100% fill the outer annular groove 94 when mounted within the pump 20. By substantially completely filling the outer annular groove 94, movement between the exterior sealing member 92, the valve plate 28, and the first end piece 60 is inhibited.

As previously described, in order to inhibit wear of the valve assembly 42, it is desirable to inhibit relative movement between the various components of the assembly. In this regard, the valve assembly 42 is preferably equipped with means for maintaining a relatively high level of constant compression between the various components of the valve assembly 42. The spacer 62 of the assembly 42 provides one exemplary configuration or technique for maintaining compression between the valve components. In one particular embodiment, the spacer 62 is generally tubular and has spring-like characteristics. For example, the spacer 62 can be made of an elastic, elastomeric, deformable or compressible material. One exemplary type of material that has the requisite elastic characteristics is polyethylene.

Referring again to FIGS. 3A and 3B, the spacer 62 is mounted in the spacer groove 64 defined between the second end 48 of the valve body 44 and the second end piece 66. The spacer groove 64 is formed by a first annular shoulder 96 defined by the second end 48 of the valve body 44, and a second annular shoulder 98 formed by the second end piece 66. The second end piece 66 also includes an inner end 100 adapted to engage the second end 48 of the valve body 44 when the valve assembly 42 is compressed between compression plates such as the valve and manifold plates 28 and 30.

In use of the valve assembly 42, the component parts are aligned as shown in FIGS. 3A and 3B and are placed in an outlet or outlet port such as one of the inlet and outlet ports 34 and 36 of the pump 20. As placed in the inlet or outlet port, the component parts of the valve assembly 42 are free to move relative to one another. Opposing compression plates, such as the valve and manifold plates 28 and 30, are used to lock or hold the component parts of the valve assembly 42 together. For example, when the valve and manifold plates 28 and 30 are bolted together, the valve assembly 42 is compressed thereinbetween. Specifically, the first and second end pieces 60 and 66 are engaged and compressed toward one another by the valve and manifold plates 28 and 30. As the valve assembly 42 is compressed, the spacer 62 is deformed, preferably without buckling or losing compression. In one particular embodiment, the spacer deforms about 0.020–0.040" without buckling or losing compression. As the spacer 62 deforms, a gap 103 (shown in FIGS. 3A and 3B) between the inner end 100 of the second end piece 66 and the second end 48 of the valve body 44 closes until the inner end 100 nearly engages the valve body 44. When the inner end 100 of the second end piece 66 nearly engages the valve body 44, the spacer 62 preferably has a volume that substantially completely fills the volume of the spacer groove 64. In other words, as shown in FIG. 2, the spacer 62 is designed to substantially 100% fill the spacer groove 64 when the valve assembly 42 is completely axially compressed.

As previously described, the poppet member 54 is biased toward the closed position shown in FIG. 3A by the poppet spring 56. It will be appreciated that a variety of spring configurations or alternative elastomeric members can be used to bias the poppet member 54 toward such a closed position. Additionally, the term "spring" is intended to include any type of elastic or elastomeric or resilient structure suitable for biasing the poppet toward a closed position. Consequently, the present invention is not limited to the particular spring configuration illustrated in the figures and described in detail as follows.

In the particular embodiment illustrated in the figures, the poppet spring 56 comprises a coil spring. The poppet spring 56 is mounted on the spring retaining structure 50 that is positioned in the valve body 44. Although a variety of configurations can be utilized, the spring retaining structure 50 includes a plurality of radial legs 102 projecting outward from a central hub portion 104. Intermediate portions of the legs 102 engage an inner annular shoulder 106 formed within the valve body 44. Distal ends of the legs 102 engage the retaining ring/washer 52 such that the spring retaining structure 50 is held within the valve body 44. The poppet spring 56 is mounted between the spring retaining structure 50 and the poppet member 54. Specifically, one end of the poppet spring 56 fits within an annular recess or groove 108 defined around the hub 104 of the spring retaining structure 50. The other end of the poppet spring 56 fits within a circular recess 110 formed in the inner side or face of the poppet member 54.

Figure 6A:
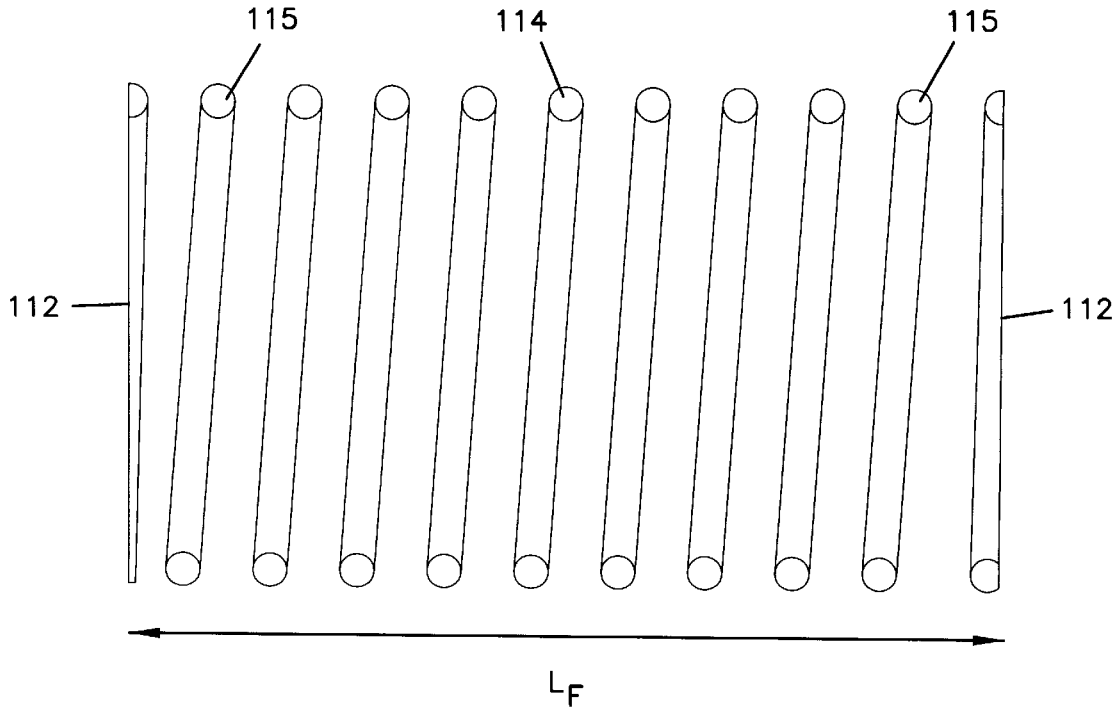
FIG. 6A illustrates a spring incorporated within the valve assembly of FIGS. 3A and 3B, the spring is shown in a noncompressed orientation.

FIGS. 3A and 3B provide a schematic depiction of the poppet spring 54. A more detailed depiction of the poppet spring 54 is provided in FIGS. 6A and 6B. As shown in FIG. 6A, the poppet spring 56 includes end coils 112 that have been flattened by means such as grinding. The end coils 112 are tilted or skewed with respect to inner coils 114 of the spring 54. The inner coils 114 are generally parallel to one another.

Figure 6B:
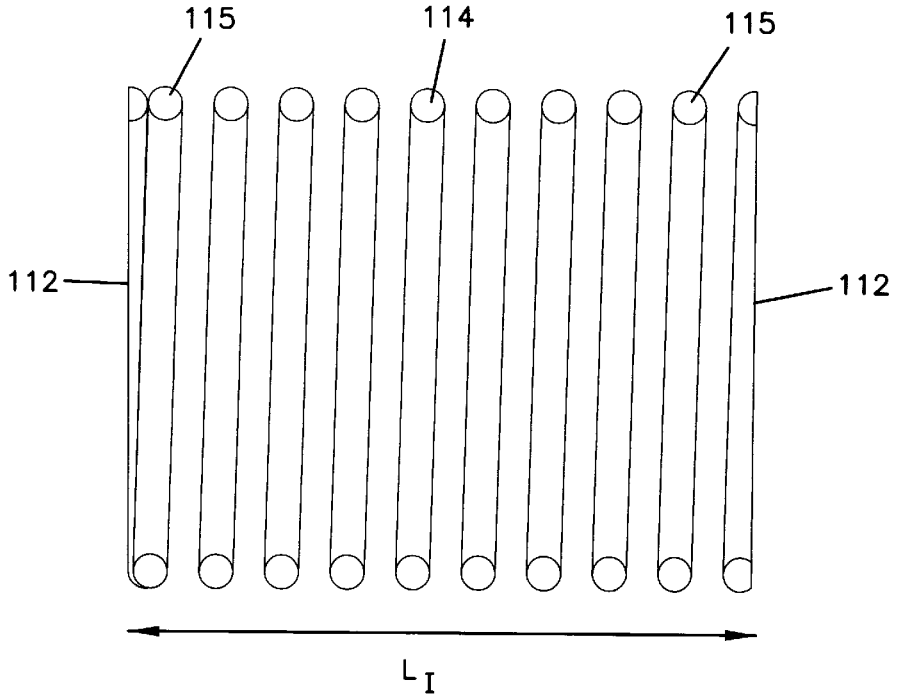
FIG. 6B illustrates the spring of FIG. 6A as it would be compressed when mounted within the valve assembly of FIG. 3A.

Because the end coils 112 have been flattened, such end portions represent the weakest or thinnest portion of the spring. Consequently, it is desirable to provide a configuration adapted for inhibiting wear of such flattened portions 112. One exemplary type configuration involves providing the spring 56 with a predetermined size and shape relative to the valve assembly 42 such that when the spring 56 is mounted in the valve assembly 42 and the poppet member 54 is in the closed position, at least one half the circumference of each flattened end coil 112 is in contact with a next innermost coil 115. Such a compressed configuration is shown in FIG. 6B. It will be appreciated that in FIG. 6B, because the coil ends are offset about 180 degrees with respect to one another, contact between the flattened end coils 112 and the next innermost coil 115 is only visible with respect to one of the flattened end coils 112.

In certain embodiments of the present invention, the coil has an installed length $L_i$ (shown in FIG. 6B) that is about 50–70% of the free length $L_f$ (shown in FIG. 6A) of the poppet spring 56. The installed length $L_i$ of the spring is the length of the spring 56 when the spring is mounted in the valve assembly 42 and the poppet member 54 is in the closed position. By designing the poppet spring 56 such that the poppet spring has a substantial preload even when the poppet member 54 is in the closed position, relative movement between flattened end portions 112 and the next innermost coils 114 is inhibited as the poppet member 54 is moved between the open and closed positions. Consequently, inside abrasive wear of the flattened end portions 112 is also inhibited.

In certain other embodiments of the present invention, relative movement between coils of a poppet spring can be reduced by reducing the spacing between the coils by using springs having an increased number of coils. Furthermore, a constant force conical compression spring in which coils do not touch each other due to diameter change, or any other type of spring could also be utilized.

Wear of the poppet spring 56 can also be inhibited by providing structures for protecting the outside of the flattened end portions 112. For example, elastomeric structures or coatings can be placed adjacent the ends of the spring 58 to reduce outside wear. As shown in FIGS. 3A and 3B, an elastomeric washer 116 is positioned within the annular groove 108 of the spring retaining structure 50, while an elastomeric disk 118 is positioned within the circular recess 110 defined by the poppet member 54. In certain embodiments, the washers/disks can be made of polyurethane or any other material demonstrating similar elastomeric characteristics.

With regard to the foregoing description, it is to be understood that changes may be made in detail, especially in matters of the construction materials employed and the size, shape, and arrangement of the parts without departing from the scope of the present invention. It is intended that the specification and depicted embodiment be considered exemplary only, with a true scope and spirit of the invention being indicated by the broad meaning of the following claims.

It is claimed:

1. A valve assembly positionable between two compression plates, the assembly comprising:

a valve body having first and second oppositely disposed ends;

a spring retaining structure disposed within the valve body;

a retaining washer positioned at the first end of the valve body for securing the spring retaining structure within the valve body;

a poppet member for controlling flow through the valve body, the poppet member being moveable between open and closed positions;

a poppet spring mounted between the spring retaining structure and the poppet member for biasing the poppet member toward the closed position;

a valve seat for providing a seal when the poppet member is in the closed position, the valve seat being captured between the retaining washer and a first end piece;

a second end piece positioned at the second end of the valve body, the second end piece and the valve body together defining a spacer groove; and an annular spacer mounted in the spacer groove between the second end piece and the valve body, the spacer being arranged and configured to be axially compressed and elastically deformed within the spacer groove when the valve assembly is pressed between the compression plates.

2. The valve assembly of claim 1, wherein the poppet member is made of a substantially rigid material, and the seat is made of an elastomeric material.

3. The valve assembly of claim 2, wherein the poppet member is made of ceramic, and the seat is made from a material selected from the group consisting of urethane and polyester.

4. The valve assembly of claim 1, wherein the spacer is sized and shaped such that when the spring spacer is compressed and deformed within the spacer groove, the spacer groove is substantially free of void space.

5. The valve assembly of claim 1, wherein the first end piece defines an annular outer groove, and the assembly further comprises a sealing member mounted in the annular outer groove, the sealing member being sized and shaped such that when the valve assembly is pressed is a port defined by one of the compression plates, the sealing member fills substantially the entire volume defined by the annular outer groove.

6. The valve assembly of claim 2, wherein the valve seat includes first and second radially spaced regions arranged and configured such that when the valve assembly is pressed between the compression plates, and the first region is required to be compressed before the second region can be compressed.

7. The valve assembly of claim 2, wherein the valve seat includes an inner side adapted to engage the poppet member and an outer side adapted to engage the first end piece, the outer side including first and second transverse seat surfaces interconnected by an axial seat surface, the outer side interfacing with a portion of the first end piece having first and second transverse end piece surfaces respectively corresponding with the first and second transverse seat surfaces, and an axial end piece surface corresponding with the axial seat surface, the axial end piece surface having an axial length that is shorter than the non-compressed axial length of the axial seat surface such that when the valve assembly is pressed between the compression plates, the first transverse seat surface is required to be compressed by the first transverse end piece surface before the second seat surface can be compressed by the second transverse end piece surface.

8. The valve assembly of claim 1, wherein the compression plates define inlet and outlet ports of a pump, and the valve assembly is mounted between the compression plates in at least one of the inlet and outlet ports.

9. The valve assembly of claim 2, wherein the valve seat includes an annular sealing surface adapted to engage the poppet member, the sealing surface having an area sufficiently large to minimize localized stresses on the sealing surface.

10. The valve assembly of claim 1, wherein the poppet spring comprises a coil spring having two oppositely disposed flattened end coils, and wherein when the valve assembly is mounted between the compression plates and the poppet member is in the closed position, at least half the circumference of each flattened end coil engages a next innermost coil of the coil spring.

11. The valve assembly of claim 10, further comprising elastomeric sealing structures positioned between one of the flattened end portions and the poppet member, and between the other of the flattened end portions and the spring retaining structure.

12. The valve assembly of claim 11, wherein the elastomeric sealing structures comprise elastomeric members.

13. The valve assembly of claim 1, wherein the spacer is made of ultra high molecular weight polyethylene.

14. A valve assembly positionable between two compression plates, the assembly comprising:

a valve body;

a poppet member for controlling flow through the valve body, the poppet member being moveable between open and closed positions;

a valve seat adapted to interface with the poppet member to provide a seal when the poppet member is in the closed position, the valve seat including first and second compression regions; and a seat retaining member adapted to engage the valve seat;

the valve seat including an inner side adapted to engage the poppet member and an outer side adapted to engage the seat retaining member, the outer side including first and second transverse seat surfaces interconnected by an axial seat surface, the outer side interfacing with a portion of the seat retaining member having first and second transverse seat retaining surfaces respectively corresponding with the first and second transverse seat surfaces, and an axial seat retaining surface corresponding with the axial seat surface, the axial seat retaining surface having an axial length that is shorter than a non-compressed axial length of the axial seat surface such that when the valve assembly is pressed between the compression plates, the first transverse seat surface is required to be compressed by the first transverse seat retaining surface before the second transverse seat surface can be compressed by the second transverse seat retaining surface to ensure compression of both.

15. A valve assembly positionable between two compression plates, the assembly comprising:

a valve body;

a poppet member for controlling flow through the valve body, the poppet member being moveable between open and closed positions;

a valve seat adapted to interface with the poppet member to provide a seal when the poppet member is in the closed position, the valve seat including first and second compression regions; and a seat retaining member adapted to engage the valve seat, the seat retaining member and the valve seat interfacing with one another such that when the valve assembly is pressed between the compression plates, the first region is required to be compressed before the second region is compressed to ensure compression of both; and the compression plates defining inlet and outlet ports of a pump, and the valve assembly being mounted between the compression plates in at least one of the inlet and outlet ports.

16. A pump comprising:

compression plates defining inlet and outlet ports;

a valve assembly positioned in at least one of the ports and compressed between the compression plates, the valve assembly including;

a valve body positioned in the at least one ports;

a poppet member for controlling flow through the valve body;

a valve seat adapted to interface with the poppet member to provide a fluid seal;

a seat retaining member compressed against the valve seat; and a deformable elastic spacer arranged and configured to axially compress the valve body and the seat retaining member together within the at least one port such that relative movement between the seat retaining member, the compression plates and the valve body is inhibited.

17. The pump of claim 16, further comprising a clamp washer compressed against the elastic spacer, wherein the elastic spacer is captured between the clamp washer and the valve body.

18. The pump of claim 17, wherein the clamp washer and the valve body cooperate to define a groove in which the spacer is elastically deformed.

19. The pump of claim 18, wherein the elastic spacer is made of ultra high molecular weight polyethylene.

* * * * *